US005081815A

United States Patent [19]

Carnell

[11] Patent Number: 5,081,815

[45] Date of Patent: Jan. 21, 1992

[54] MECHANIZED SHINGLE APPLYING APPARATUS

[76] Inventor: Joe W. Carnell, Rte. 4, Box 124, Ozark, Ala. 36360

[21] Appl. No.: 553,233

[22] Filed: Jul. 16, 1990

[51] Int. Cl.[5] ..... E04B 01/00

[52] U.S. Cl. ..... 52/747; 227/110; 52/749

[58] Field of Search ..... 52/747, 748, 749; 404/99; 227/111, 110, 154

[56] References Cited

U.S. PATENT DOCUMENTS

| | | | |
|---|---|---|---|
| 3,794,237 | 2/1974 | Hernandez | 227/111 |
| 3,972,462 | 8/1976 | Evans et al. | 227/111 |
| 3,984,040 | 10/1976 | Fry | 227/111 X |
| 4,036,422 | 7/1977 | Harvey | 227/110 |
| 4,084,738 | 4/1978 | Schneider | 227/111 X |
| 4,265,387 | 5/1981 | Strouse | 227/111 X |
| 4,656,808 | 4/1987 | Mansfield | 52/749 |
| 4,732,307 | 3/1988 | Hubbard et al. | 227/111 X |

*Primary Examiner*—David A. Scherbel
*Assistant Examiner*—Lan Mai
*Attorney, Agent, or Firm*—Jennings, Carter, Thompson & Veal

[57] ABSTRACT

Apparatus for applying shingles to a roof having a guidetrack connected to the roof, a pair of guiderods slidably connected to the guidetrack in perpendicular extension therefrom, a primary carriage mounted to the guiderods for movement parallel the guidetrack, a gun carriage mounted within the primary carriage, but independently supported therein for concomitant horizontal motion therewith and a chute for conveying shingles placed thereon beneath the gun carriage.

34 Claims, 10 Drawing Sheets

FIG. 8
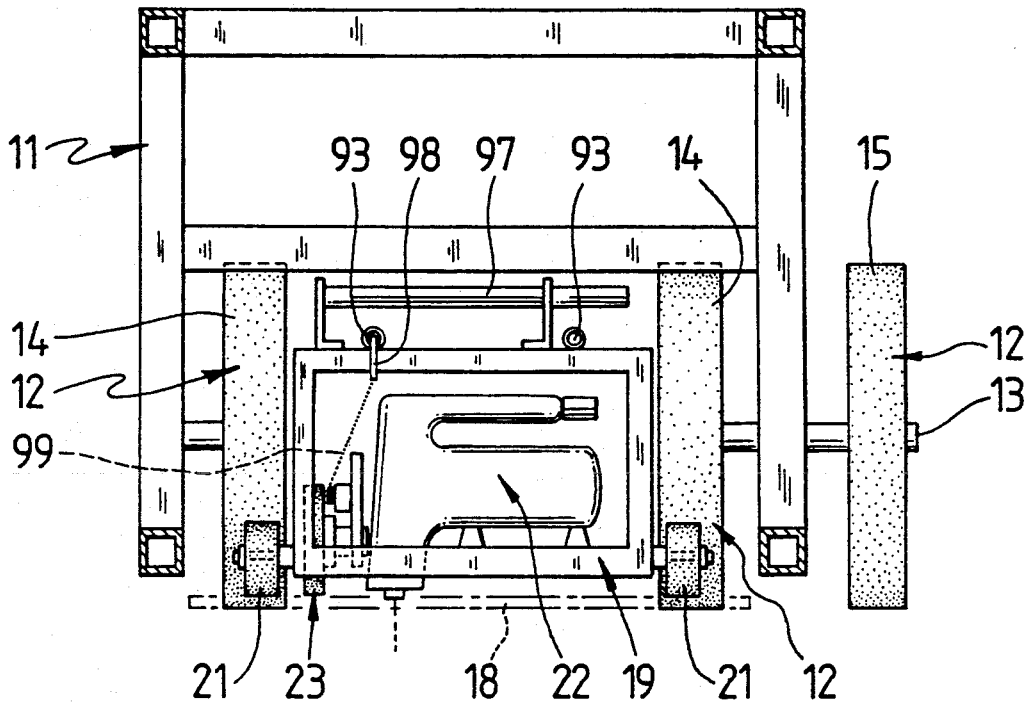
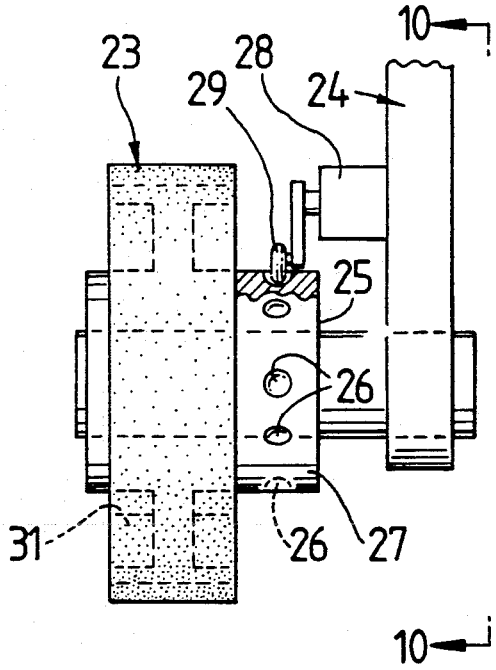
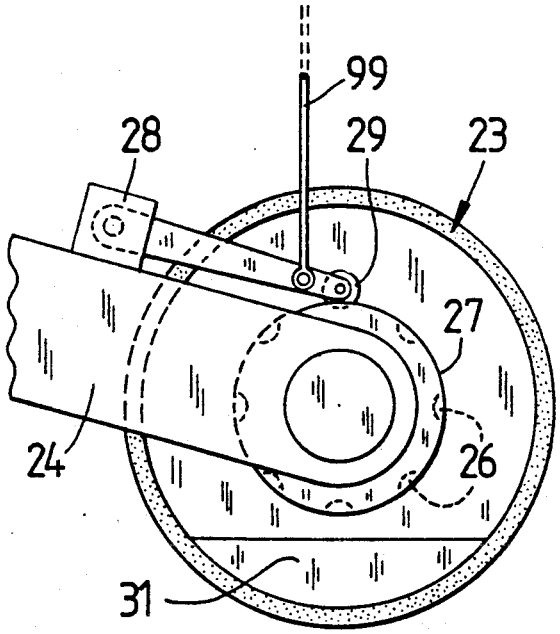
FIG. 9
FIG. 10

101
102
103
104
106
107
108
109
111
112
113
114
116
118
119
121
14
15

MECHANIZED SHINGLE APPLYING APPARATUS

FIELD OF THE INVENTION

The present invention relates to shingle applying apparatus and more particularly to apparatus for laying and fastening shingles to a roof. In greater particularity, the present invention relates to apparatus for concurrently aligning and stapling shingles in a plurality of rows across a planar surface.

BACKGROUND OF THE INVENTION

Applying shingles to a roof has typically been manually performed by placing one shingle at a time to the roof and either stapling or nailing that shingle with a hammer or pneumatic gun. The process requires continuous bending typically resulting in concentrated stress in the back and knees of the roofer. Manual roofing is a tedious and substantially time-consuming operation. An unusual proportion of time is utilized in moving shingles to the work area, positioning each shingle before nailing, then moving the whole operation across the roof after the application of a series of shingles has removed the roofer from his source of shingles. Shingles are typically applied to the roof in rows, requiring the roofer to draw a line across the roof along which the top of each shingle in that row must be meticulously aligned. Obviously, manual application of shingles is a time-consuming and strenuous operation.

Numerous shingle applying apparatus have been utilized in an attempt to alleviate the rigors of manual roofing. Examples of such apparatus include the following: U.S. Pat. No. 3,972,462 issued to Evans et.al. teaches a frame supported by wheels for lateral movement across a roof. The frame supports a chute on which a shingle is placed to slide against a guidebar. The guidebar is aligned in relation to the upper edge of a row of shingles previously connected to the roof. The frame supports a plurality of nail guns which are selectively pivoted to engage the shingle currently positioned on the chute and fasten each shingle to the roof.

U.S. Pat. No. 4,656,808 issued to Mansfield teaches a drum mounted for rotation in a frame. Shingles are placed on the drum, being secured thereon by ridges connected to the drum specially fitted for engagement within rain-grooves typically defined on such shingles. As the drum is rolled forward, the shingle is conveyed thereon to contact the roof. The shingle is gravitationally disengaged from the drum and automatically nailed by a nail gun. The drum may be indexed up the slope of the roof by a pair of hydraulic pistons mounted on cross-shafts.

As shown in FIG. 5, Evans et.al. requires that the shingle be laterally forced across a chute thereby bending the shingle at its most inflexible point. Shingles are typically made of a semi-rigid combination of tar and granular material such as sand and gravel. Though the shingle could be easily bent along its length, substantial lateral bending will damage the shingle. Evans et.al. still requires the user to bend over on his knees during the entire shingle applying procedure. Each shingle must be laid one at a time with the machine being moved and reset between the placement of each shingle. Since the invention taught in Evans et.al. is designed to lay shingles guided by the upper edge of a previously laid row, the first row would have to be applied to the roof by hand. Evans et.al. teaches a machine which can only overlap the shingles by one predetermined distance. Also, each row of shingles must be laid parallel to the other rows even though fanning the rows of shingles across the roof is a necessary practice to accommodate uneven eaves and gables. It appears that the traditional problems with laying shingles have not been eliminated by the invention taught in Evans et.al.

The invention taught by Mansfield in U.S. Pat. No. 4,656,808 must be kept in alignment visually. The invention taught by Mansfield must also be stopped to load a shingle or in the alternative requires two operators for continuous motion. Though the invention taught in Mansfield may be indexed up the roof's slope, the index distance and consequently the overlap of the shingles applied by such invention are non-adjustable. As previously mentioned, shingles are secured to the drum by fitting the rain-grooves defined by the shingles over and around a plurality of ridges circumferentially spaced around the drum. However, there currently exists many styles of shingles that no longer utilize raingrooves and the invention taught by Mansfield would not be able to apply such shingles. Mansfield teaches of stapler means automatically triggered by the rotation of the drum. However, the stapler means are mounted on the frame and as the drum is propelled forward the stapler means are suspended a substantial distance above the roof. This distance varies since the frame is pivotally mounted to the drum being susceptible to a rocking motion as the drum is propelled. Consequently, as the staples are fired from the stapler means, their accuracy is affected by the rocking motion of the frame. By being suspended above the surface of the roof, the stapler means will not be able to consistently project staples into the shingle. Close proximity of the stapler means discharge portal with the shingle to be stapled is required to project the staple completely within the shingle and the underlying roof. If the staple does not completely extend within the shingle and the underlying roof, other shingles applied over such staples will be damaged by the protruding staple thereby resulting in leakage.

SUMMARY OF THE INVENTION

It is the principal object of the present invention to provide apparatus for mechanically applying and securing shingles to a roof which can be operated from a standing position.

In support of the principal object, another object of the present invention is to provide apparatus for applying shingles through which such shingles can be continually fed by a single operator, wherein more than one shingle is in process at any given time.

Yet another object of the invention is to provide an improved automatic securing mechanism which travels across the shingle to be presently secured, uninfluenced by the vertical movement of other components of the invention.

Still another object of the invention is to reduce the visual attention the operator must maintain to guide the apparatus in a predetermined direction.

A further object of the invention is to provide apparatus for applying and securing shingles to a roof which can vary the amount of overlap each row of shingles extends over the prior row of shingles.

Yet another object of the present invention is to provide apparatus for mechanically applying and securing shingles to a roof which will apply shingles with or without raingrooves and in individual or in continuous roll form.

These and other objects and advantages of my invention are accomplished through the use of a primary carriage mounted to a guidetrack for parallel movement therewith by a pair of guide rods slidably mounted to the guidetrack and fixably mounted to the primary carriage. A gun carriage is encompassed within the primary carriage being independently supported therein for concomitant horizontal motion therewith. A chute mounted to the primary carriage extends proximal the gun carriage for delivering shingles beneath the gun carriage. As the shingles pass below the gun carriage, a measuring wheel pivotally mounted to the gun carriage is rotated and periodically activates a stapler which is mounted to the gun carriage in close proximity to the shingle passing thereunder. A plurality of rollers and a pivotal mount are provided to convey shingles packaged in interconnected roll form down the chute and under the gun carriage or shingles may be fed down the chute individually. A set of pneumatically distendable wheels are mounted to the primary carriage and when distended lift the carriage from the roof for movement parallel the slope thereof. Holes drilled in the guide rod pins mounted on the primary carriage are used to index the movement of the primary carriage up the guiderods thereby positioning the carriage to apply the next row of shingles. The guidetrack, to which the primary carriage is mounted, can be adjusted to vary the overlap of each row of shingles and/or for the rows of shingles in a predetermined pattern.

BRIEF DESCRIPTION OF THE DRAWINGS

Apparatus embodying features of my invention are depicted in the accompanying drawings which form a portion of this disclosure and wherein:

FIG. 8 is a sectional view taken along line 8—8 of FIG. 5;

FIG. 9 is an enlarged detail view of th' firing mechanism;

FIG. 10 is a sectional view taken along line 10—10 of FIG. 9;

FIG. 13 is a perspective view of the shingle cutting apparatus.

DESCRIPTION OF A PREFERRED EMBODIMENTS

Figure 1:
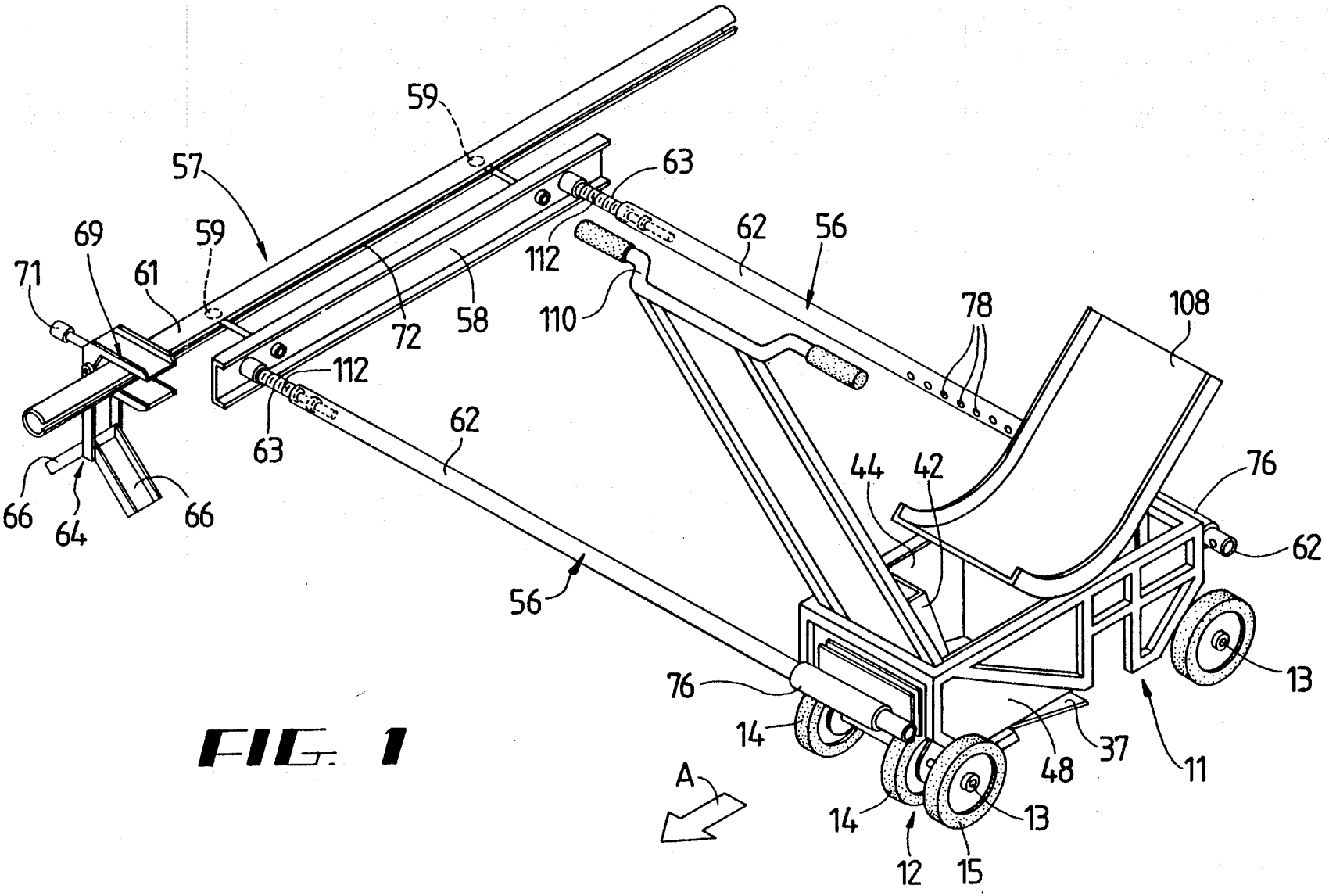
FIG. 1 is a perspective view of the present invention.

Referring to the drawings for a clearer understanding of the invention, it should be noted in FIGS. 1-7 that the present invention contemplates the use of a primary carriage 11 supported by a first set of wheels 12. The first set of wheels are mounted on a plurality of axles 13 for rotation about a horizontal axis in a direction consistent with the longitudinal motion of the primary carriage 11. As shown in FIG. 8, each axle 13 supports at least three wheels 12 with at least two of the three wheels 12 being mounted on each axle 13 below the primary carriage 11 and hereinafter referred to as inner wheels 14 and at least one of the three wheels 12 being mounted on each axle 13 beyond the lateral extension of the primary carriage 11 and hereinafter referred to as outer wheels 15. The outer wheels 15 help stabilize the primary carriage 11 on the steep grades commonly encountered on a roof 16.

Laterally encompassed within the confines of the primary carriage 11 but independently supported therein is a means for mechanically securing shingles 18 to the roof 16. As shown in FIGS. 3 and 5-8, the securing means includes a gun carriage 19 independently supported within the primary carriage 11 by a second set of wheels 21 for concomitant horizontal motion with the primary carriage 11. A projecting means 22, preferably a pneumatic staple gun but not limited thereto, is mounted to the gun carriage 19 to project staples or other suitable fasteners in a downward direction. As shown in FIGS. 8-10, the projecting means 22 is activated by an automatic firing means which includes a measuring wheel 23 rotably mounted to an arm 24 which is pivotally mounted to the gun carriage 19 for movement about a horizontal axis. The measuring wheel 23 rotates in directions consistent with the rotational motion of the second set of wheels 21 wherein the measuring wheel 23 is pivotally mounted to tangentially contact any planar surface supporting the second set of wheels 21 and is spring loaded to adjust to minor imperfections on said planar surfaces. A circular hub 25, having a recess 26 defined on its outer girdle 27, is mounted to the measuring wheel 23 for concomitant rotation therewith. A micro-switch 28, mounted to the arm 24 and operatively connected to the projecting means 22, has an activating follower 29 biased to contact the girdle 27 of the hub 25. As the primary carriage 11 is propelled forward, the gun carriage 19 is moved forward. The measuring wheel 23, being in contact with the same surface that supports the second set of wheels 21, also rolls forward. As the measuring wheel 23 rotates, the activating follower 29 moves in and out of the recess 26 consequently activating the projecting means 22 at predetermined intervals of distance traveled by the gun carriage 19. The gun carriage 19, being independently supported by the second set of wheels 21, permits the projecting mean 22 to operate in close proximity to the surface to be stapled without influence from any vertical oscillation of the primary carriage 11. The measuring wheel 23 carries a counterweight 31 which gravitationally repositions the measuring wheel 23 and the hub 25 to a predetermined position when the gun carriage 19 and consequently the measuring wheel 23 are lifted from contact with the planar surface currently supporting the second set of wheels 21.

Figure 3:
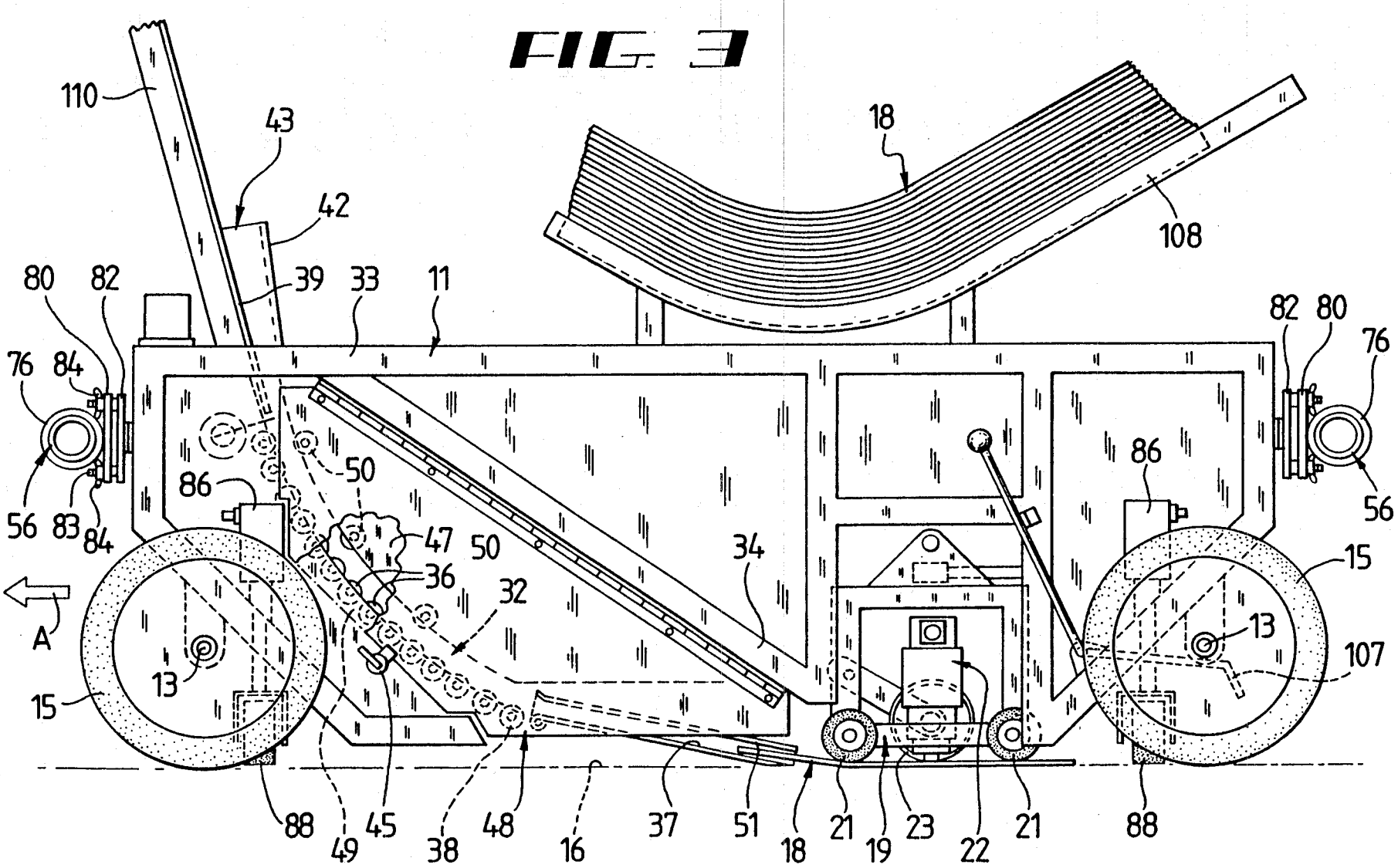
FIG. 3 is a side elevational view of the primary carriage with gun carriage encompassed therein.
Figure 4:
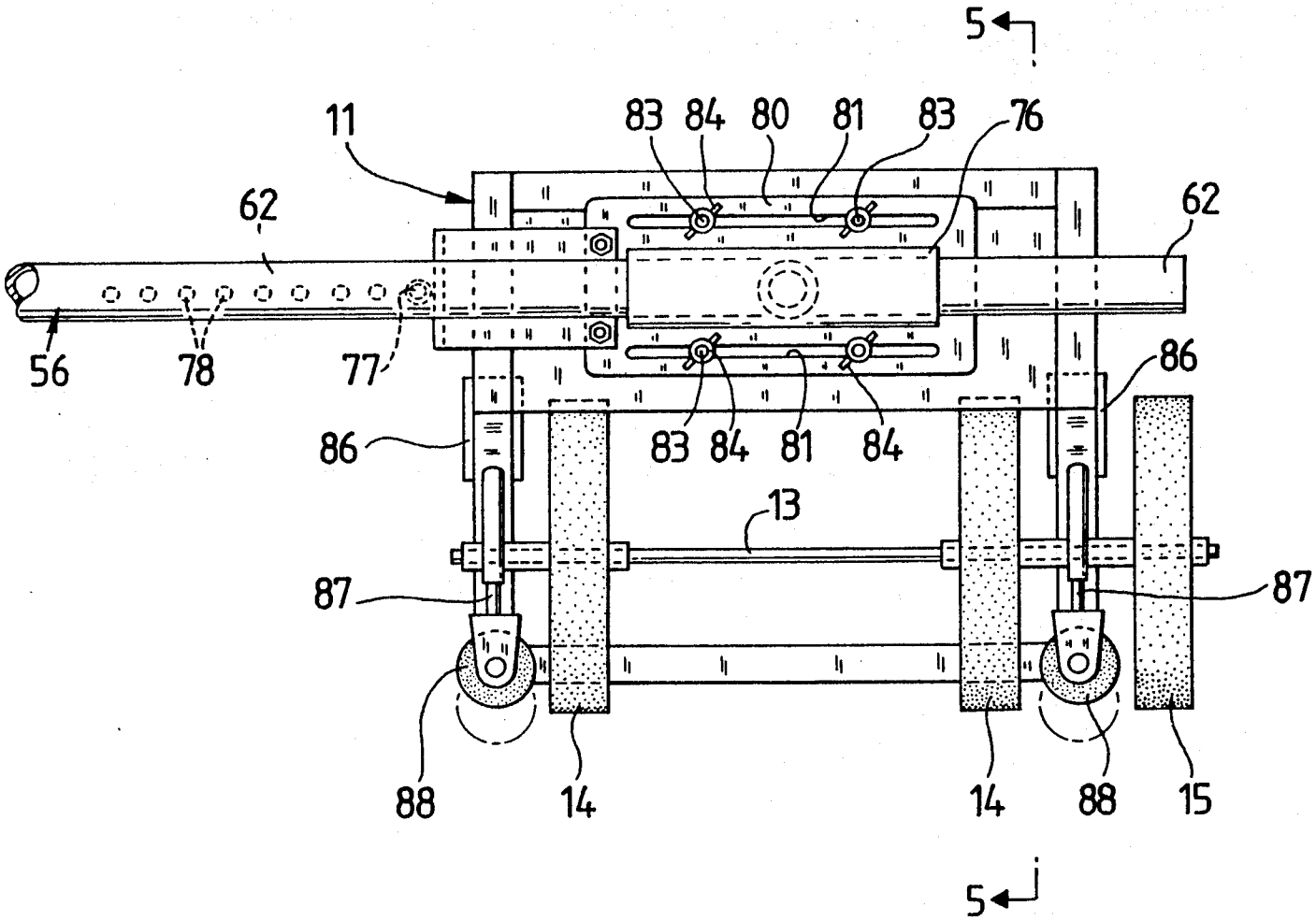
FIG. 4 is an end elevational view of the primary carriage.
Figure 6:
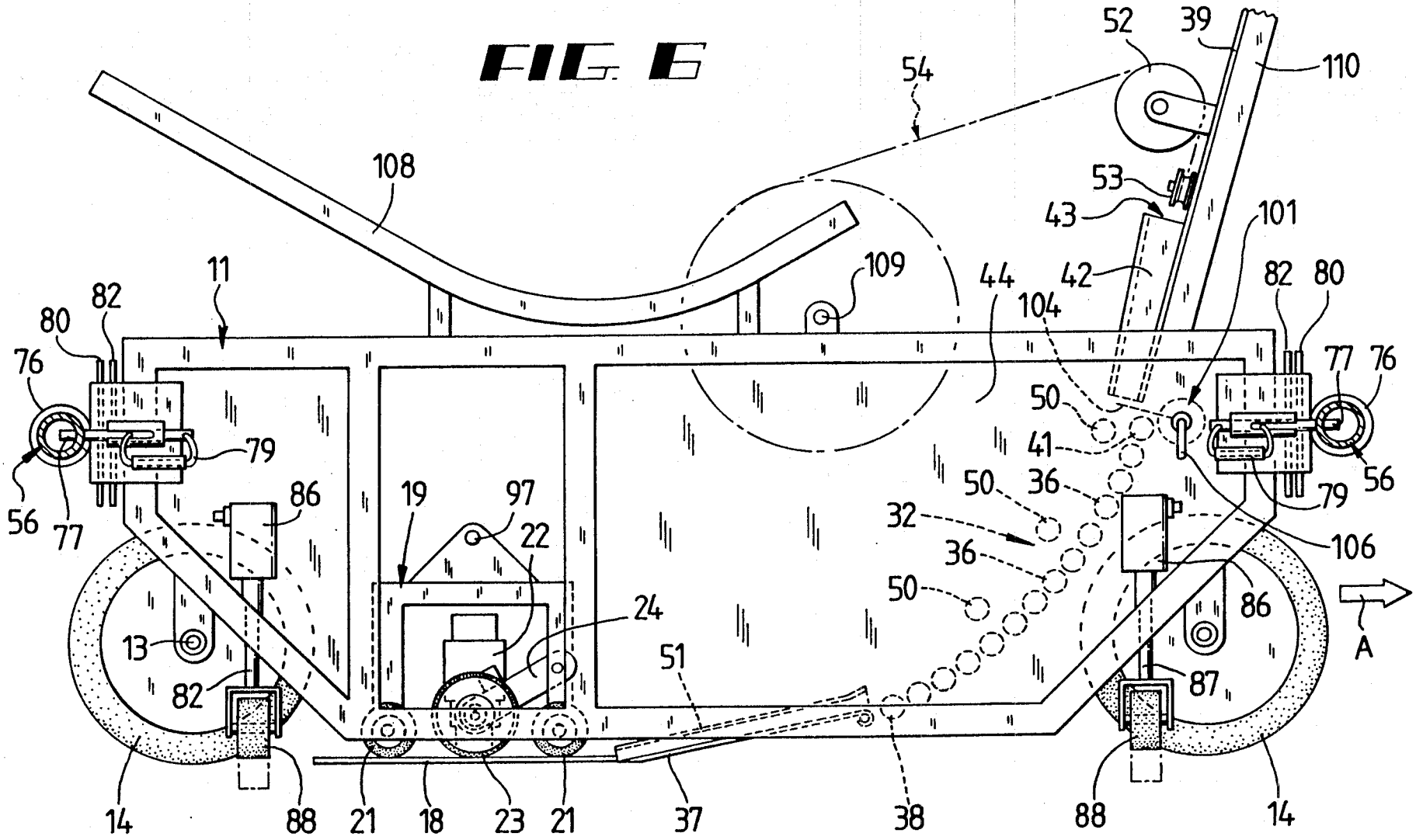
FIG. 6 is a side elevational view of the side opposite that shown in 3.
Figure 7:
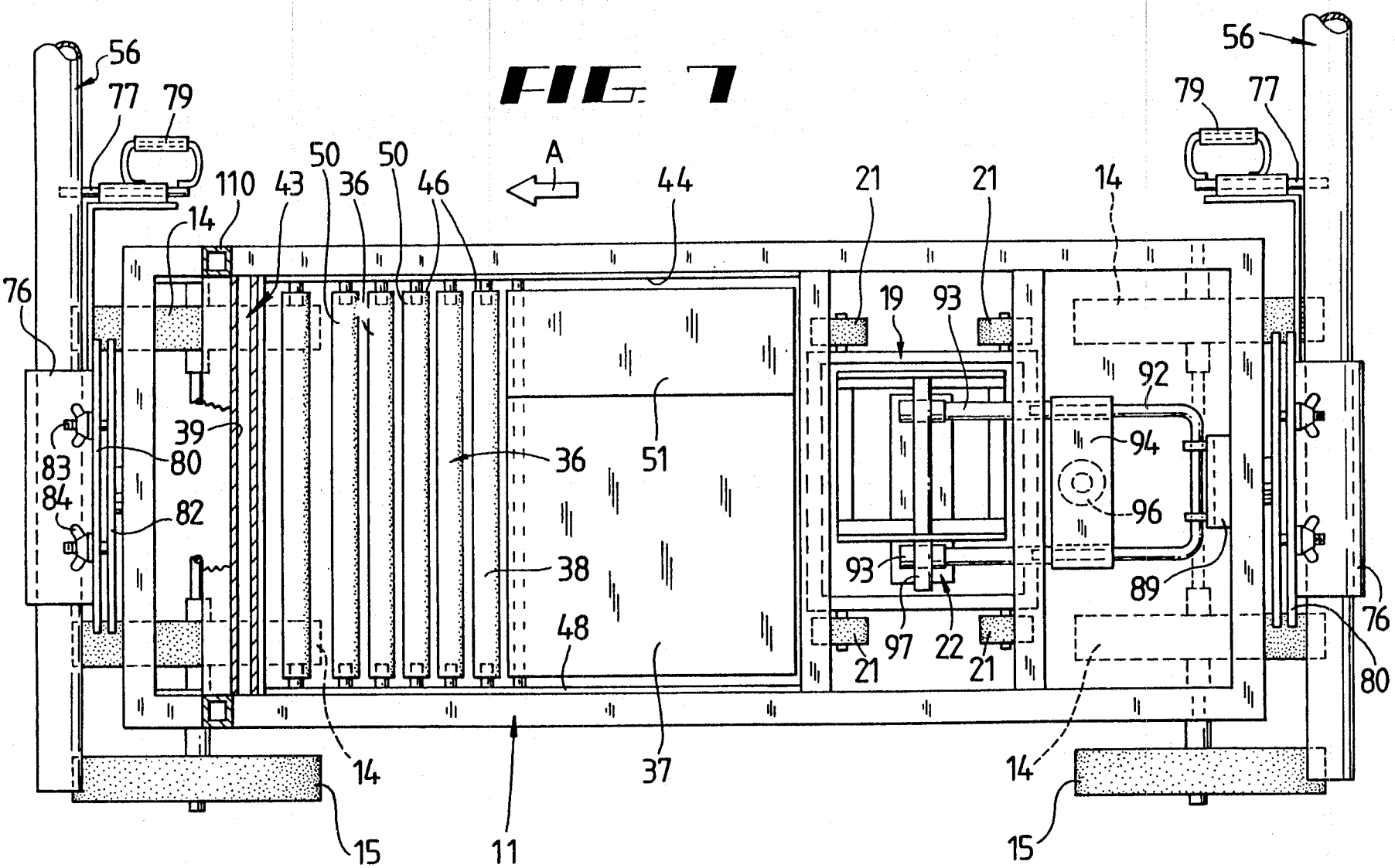
FIG. 7 is a top plan view of the primary carriage.

A means for conveying shingles 18 beneath the gun carriage 19 is mounted to the primary carriage 11 and, as shown in FIGS. 3, 6, and 7, includes an arcuate chute 32 mounted within the primary carriage 11. The chute extends from a forward upper end 33 of the primary carriage downward and rearward to a lower end 34 positioned adjacent the second set of wheels 21. The chute 32 includes a plurality of laterally extending parallel chute rollers 36 which are mounted to the primary carriage 11 in a downwardly and rearwardly extending arcuate formation. A deflector pan 37 is pivotally mounted to the primary carriage 11 adjacent a lowermost roller 38 of the plurality of chute rollers 36. The chute 32 includes an entry slide 39 mounted to the primary carriage 11 above an uppermost roller 41 of the plurality of chute rollers 36, wherein the entry slide 39 extends upwardly from the primary carriage 11 in tangent relation to the arcuate formation of chute rollers 36. The entry slide 39 has a cover 42 mounted thereon which converges with the entry slide 39 toward the uppermost roller 41 to form an entry portal 43. A first guidewall 44 is mounted to the primary carriage 11 in normal relation to a first edge 46 of the arcuate formation of chute rollers 36. A second guidewall 48 is pivotally mounted to the primary carriage 11, being detachably secured in a vertical plane normal a second edge 49 of the arcuate formation of chute rollers 36 by a latch 45. An auxiliary panel 47 is mounted to the primary carriage 11 opposite the first guidewall 44 in spaced relation thereto, with the lower edge of the auxiliary panel 47 coextending the second edge 49 of the arcuate formation of chute rollers 36 a predetermined distance thereabove. Means for restricting the vertical movement of the shingles 18 moving down the chute 32 are connected to the first guidewall 44, the auxiliary panel 47 and the deflector pan 37. The restricting means includes a plurality of restrictive rollers 50 mounted intermediate the first guidewall 44 and the auxiliary panel 47 for rotational movement about parallel horizontal axis. The restrictive rollers 50 are mounted in an arcuate formation which coextends the chute rollers 36 in spaced relation thereabove. A shield 51 is integrally connected to the edge of the deflector pan 37 adjacent the first guidewall 44 and extends upward and over the deflector pan 37 in spaced relation thereto. As seen in FIG. 6, an idler roller 52 is detachably mounted to the entry slide 39 above the cover 42 and parallel the chute rollers 36 for rotational movement about a horizontal axis. A guide roller 53 is pivotally mounted to the entry slide 39 subjacent and orthogonal the idler roller 52. The guide roller 53 is biased parallel the rotational axis of the idler roller 52 toward the vertical plane encompassing the second guidewall 48.

The conveying means is adapted to convey either a plurality of individual shingles or a continuous strip of roofing material 54. In a first embodiment, individual shingles 18 are placed on the entry slide and gravitationally move along the chute rollers 36 and the deflector pan 37 to rest between the second set of wheels 21 and the roof 16. When shingles 18 are being applied to a roof 16 the primary carriage 11 will be moving perpendicular the slope thereof with the second guidewall 48 being positioned downslope from the chute rollers 36. Shingles 16 moving down the chute rollers 36 are thereby gravitationally pulled against the second guidewall 48 being aligned prior to passing beneath the gun carriage 19.

In a second embodiment, a strip of roll roofing material 54 must be manually fed over the idler roller 52, adjacent the guide roller, beneath the cover 42, down the chute rollers 36, beneath the deflector shield and beneath the second set of wheels 21. After the strip is secured to the roof by a fastener, the forward motion of the primary carriage 11 will draw the strip 54 through the conveying means for subsequent application to the roof. The guide roller 52 biases the strip 54 against the second guidewall 48 thereby aligning the strip 54 parallel the forward motion of the primary carriage 11 prior to passage beneath the gun carriage 19. The restrictive rollers 50 serve a dual purpose by preventing individual shingles 16 moving down the chute rollers 36 from bucking upward or overlapping on one another while providing a low friction conduit along which the strip 54 of roofing material can be conveyed.

Figure 2:
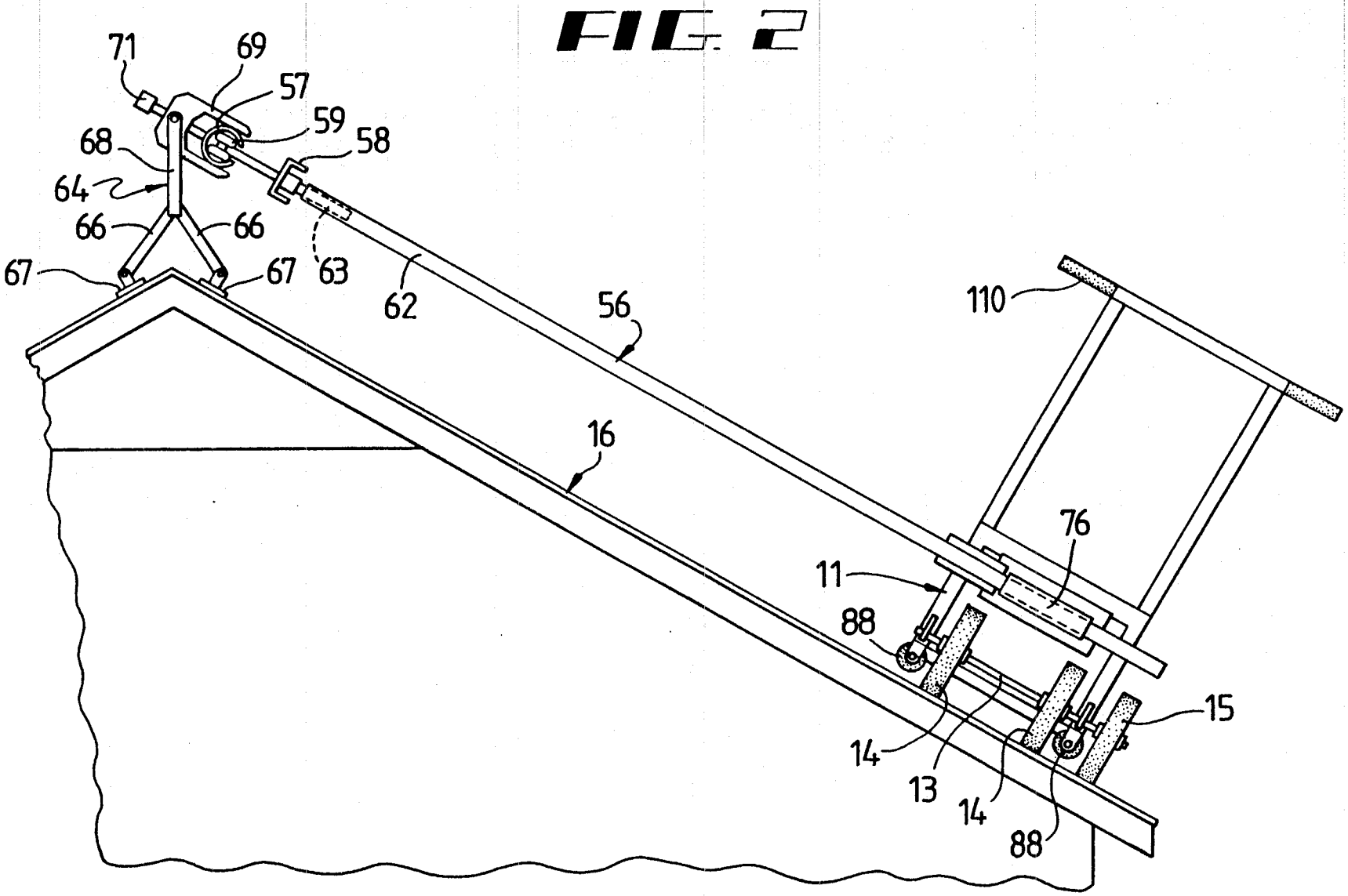
FIG. 2 is an end elevational view of the present invention on slope of a roof.
Figure 11:
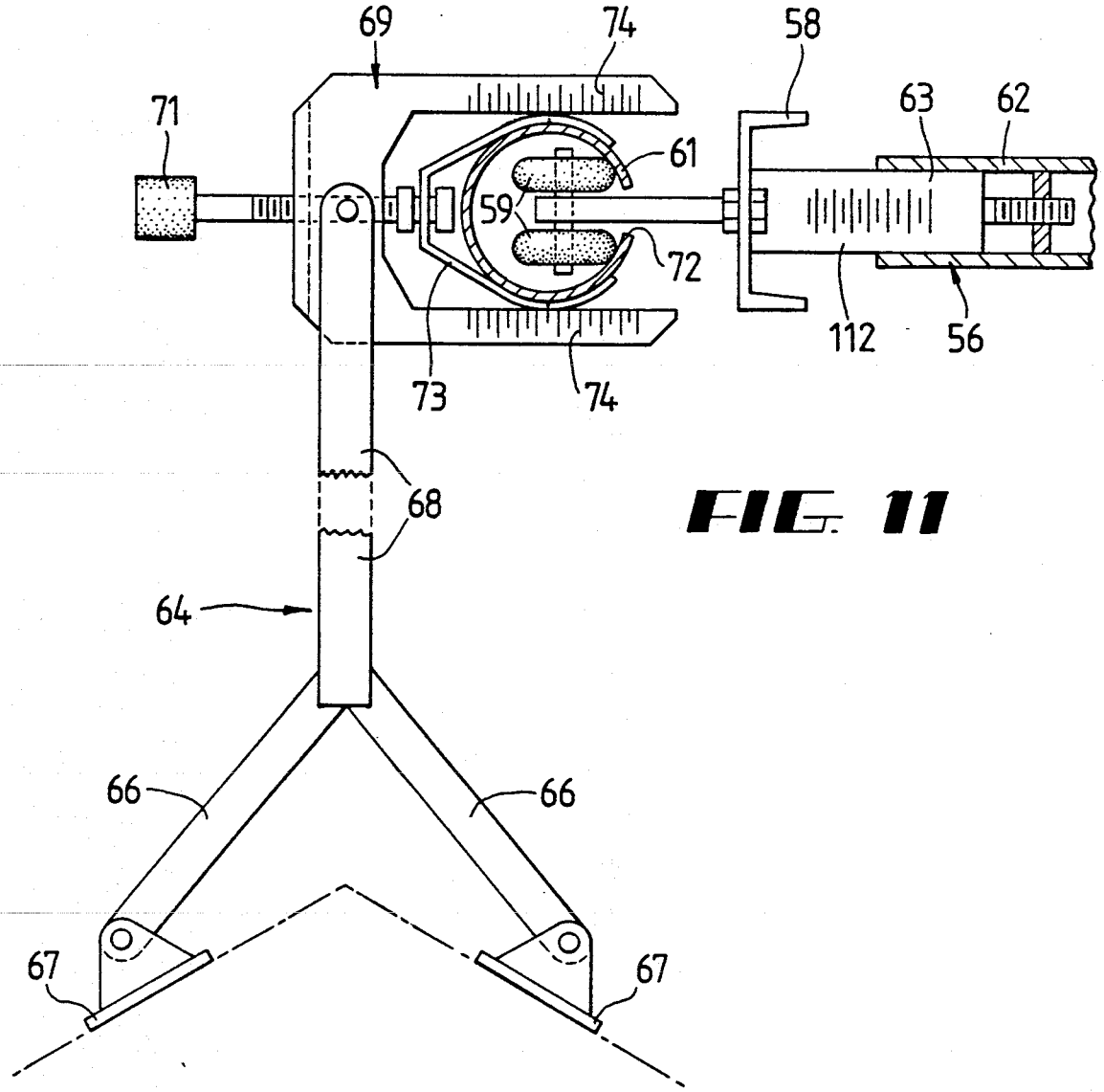
FIG. 11 is a side elevational view of the support stand and guide track.
Figure 12:
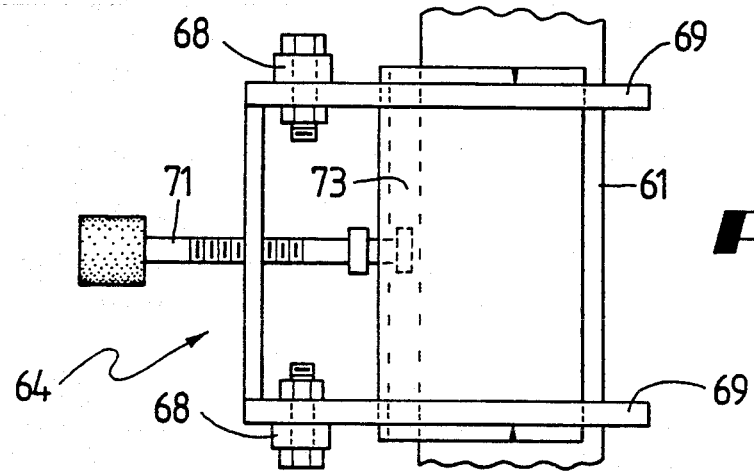
FIG. 12 is a top plan view of the support stand and guide track.
Figures 14, 15, 16, 17:
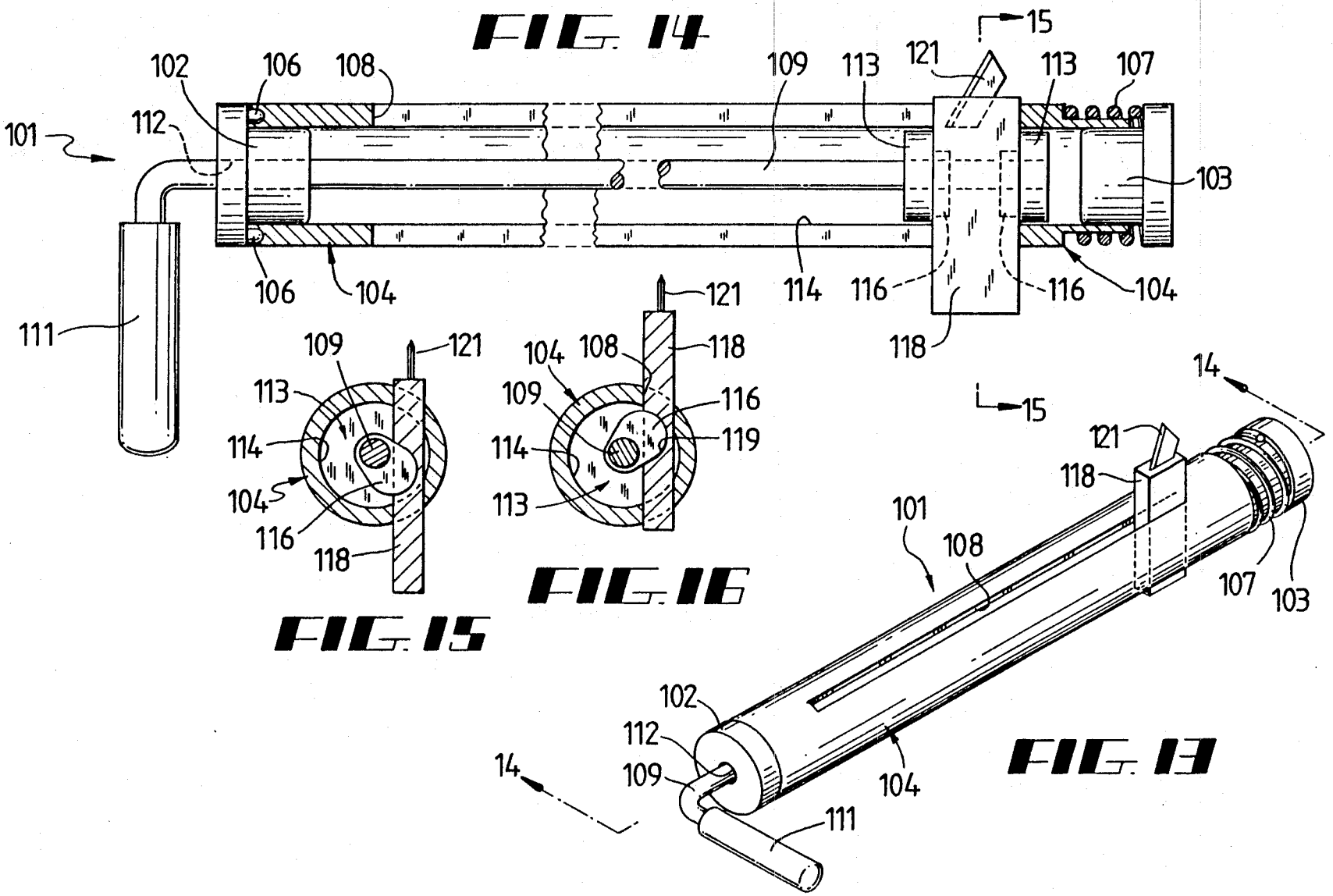
FIG. 14 is a sectional view of the shingle cutting apparatus take line 14—14 of FIG. 13.
FIG. 15 is a sectional view taken along line 15—15 of FIG. 14 cutter block retracted.
FIG. 16 is a sectional view showing the cutter block extended.

The primary carriage's 11 direction of travel is selectively restricted by a guiding means mounted to the primary carriage 11 and the roof 16. As shown in FIGS. 1 and 2, the guiding means includes a plurality of guide rods 56 pivotally mounted to the primary carriage 11 and slidably mounted to a guide track 57 which is detachably mounted to the roof 16. A crossbar 58 is mounted to the ends of the guide rods 56 located distal the primary carriage 11 in perpendicular relation to the guide rods 56. A plurality of track rollers 59 are fixably connected to the crossbar 58 and are slidably engaged within an elongated channel member 61 which forms a portion of the guide track 57. Each guide rod 56 includes a tubular portion 62 pivotally mounted to the primary carriage 11 and an extension rod 63 threadably engaged within the tubular portion 62 in linear extension therefrom and rotatably mounted to the crossbar 58. As shown in FIGS. 1, 2, 11 and 12, the channel member 61 is mounted to a plurality of support stands 64, each of which includes a plurality of legs 66, each supported by a pad 67 pivotally mounted thereunder; two vertical plate members 68 connected to the legs 66 in upward extension therefrom; and a U-shaped adjusting head 69 mounted intermediate the vertical beam members 68 for pivotal movement about a horizontal axis. As shown in FIGS. 11 and 12, the channel member 61 is secured within each adjusting head 69 by a bolt 71 threadably engaged within the adjusting head 69 and rotatably mounted to the channel member 61. The channel member 61 is cross-sectionally C-shaped, having a travel slot 72 through which the track rollers 59 extend and a plurality of brackets 73 mounted opposite the travel slot 72 to which the bolts 71 are mounted in rotational engagement therein. The adjusting heads 69 include indicia 74 which aid the operator in setting a selected angular relationship between the channel and the plurality of support stands. Note that one channel member can be linearly connected to other channel members to extend the length of the guide track 57 any desired distance. As shown in FIGS. 1–4 and 6–7, a plurality of tubular casings 76 are pivotally mounted to the forward and rearward ends of the primary carriage 11. Each guide rod 56 extends through one of the plurality of casings 76 being secured therein by an index pin 77 which is slidably mounted to the casing 76 in perpendicular relation thereto. Each index pin 77 is selectively inserted within one of a plurality of index holes 78 which are located in evenly spaced increments along each guide rod 56, wherein the distance between the centers of each hole is equal to a predetermined overlap of shingles 18. A handle 79 is connected to each index pin 77 for sliding the index pin 77 within the index holes 78. Each casing 76 is connected to a support plate 80 having a plurality of adjustment slots 81 thereon. The support plate 80 is mounted to a pivot panel 82 by a plurality of posts 83 and wingnuts 84 for selected sliding movement thereon. The pivot panel 82 is mounted to the primary carriage 11 for pivotal movement about a horizontal axis. The connection between the support plate 80 and the pivot panel 82 permits the operator to adjust the angular alignment of the primary carriage 11 relative to the channel member 61.

As shown in FIGS. 3–6, means for raising the primary carriage 11 are mounted thereon and include a plurality of downwardly extending, fluid operated, linear actuators 86, each mounted to the primary carriage 11 having a distendable rod 87 with a caster 88 mounted thereunder. The casters 88 are mounted for rotation about a horizontal axis parallel the longitudinal axis of the primary carriage 11. Note that the casters 88 could be pivotally mounted to the actuators 86 to roll in any direction. The linear actuators 86 when activated raise the primary carriage 11 from the roof 16, allowing the primary carriage 11 to be rolled up the slope of the roof 16 on the casters 88 to the next indexed position on the guide rods 56.

Figure 5:
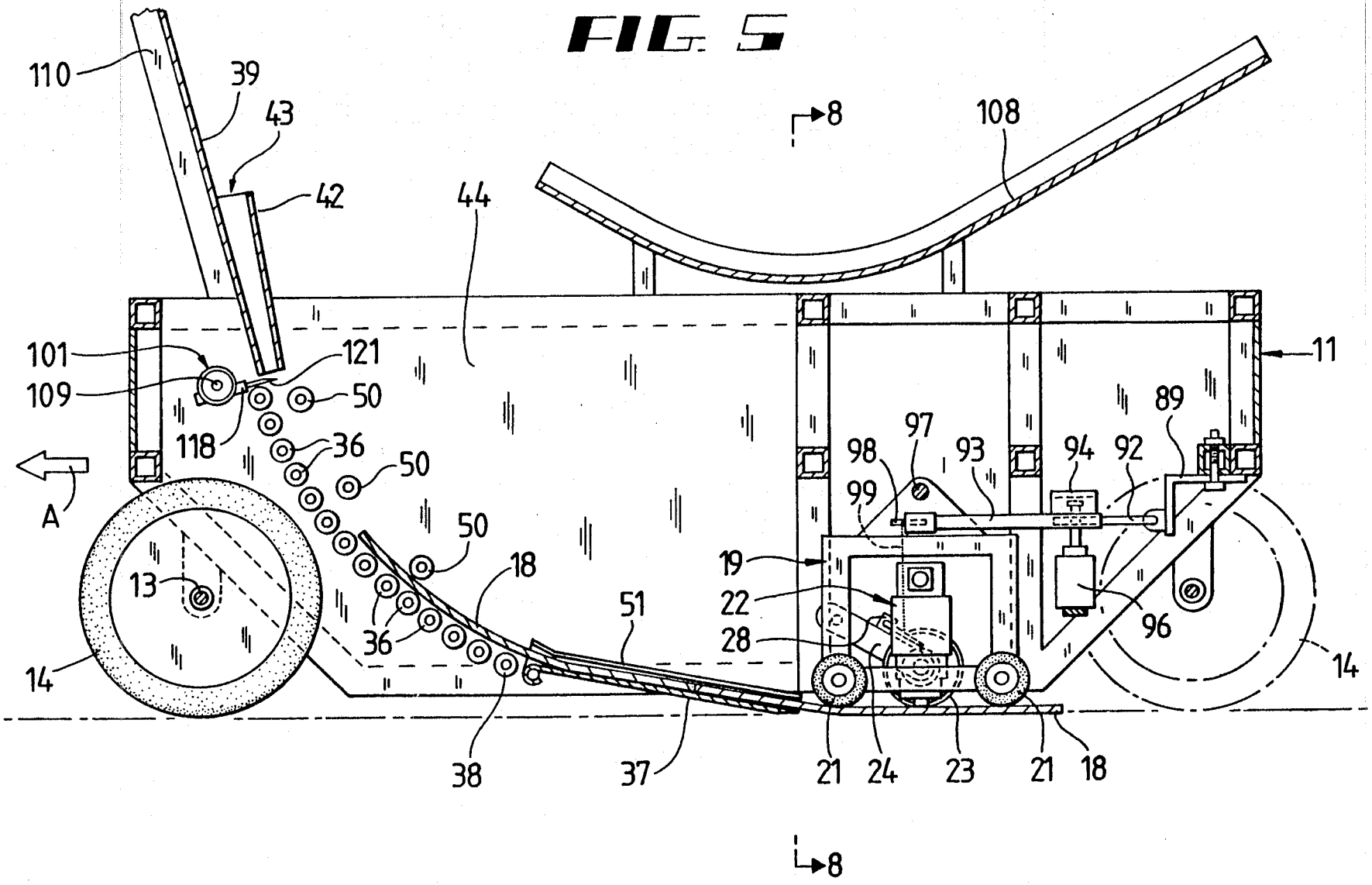
FIG. 5 is a sectional view taken along line 5—5 of FIG. 4.

As shown in FIGS. 5 and 7, a lifting means is mounted to the primary carriage 11 for lifting the gun carriage 19 and includes an L-shaped base 89 mounted to the primary carriage 11, a pair of parallel telescoping lift arms 92 pivotally mounted to the base 89 each having an outer portion 93 which extend toward the gun carriage 19, a lift plate 94 connecting the outer portions 93 of each telescoping lift arm 92, and a fluid operated linear actuator assembly 96 mounted to the primary carriage 11 subjacent the lift plate 94. When outer portions 93 of lift arms 92 are moved toward the gun carriage they extend below a lift bar 97 mounted to the gun carriage 19. When the linear actuator assembly 96 is activated the lift plate 93 and lift arms 92 are raised, thereby contacting and lifting the lift bar 97 and the gun carriage 19. A means for automatically disabling the projecting means 22 is mounted to the gun carriage 19 and includes a lever arm 98 mounted to the gun carriage 19 above the micro-switch 28 for pivotal movement about a horizontal axis. The lever arm 98 extends within the outer portion of one of the telescoping lift arms 92 when the lift arms 92 are telescoped beneath the lift bar 97. A linkage 99 is connected intermediate the lever arm 98 and the activating follower 29 and as the lift arms 92 are raised to contact the lift bar 97 the activating follower 29 is lifted from the hub 25.

As shown in FIGS. 3, 5, & 6, a shingle knife 101 is mounted to the primary carriage 11 subjacent and parallel the lower edge of the entry slide 39. As shown in FIGS. 13–16, the shingle knife 101 includes a first plug 102 and a second plug 103 mounted to the primary carriage in laterally spaced relation thereon. A tubular sheath 104 is slidably mounted intermediate the plugs 102 and 103 and is detachably secured in non-rotational engagement there-between by a plurality of lugs 106 which extend from the first plug 103. A spring 107 is mounted intermediate the second plug 103 and the sheath 104 and biases the sheath 104 toward the first plug 102. A pair of parallel slots 108 are defined by the sheath 106 in non-diametric relation therein. An elongated rod 109 having a handle 111 is slidably engaged within an aperture 112 coaxially extending through the first plug 103. A pair of cylindrical slides 113 coaxially engage the rod 109 distal the handle 111 and have radial diameter substantially equal to the interior diameter 114 of the tubular sheath 104. Each slide 113 includes a teardrop shaped cam 16 connected to a face 116 thereof for concomitant rotation therewith. A cutter block 118 extends within the sheath 104 in coplanar relation to the slots 108 and is detachably secured therein by the teardrop cams 116 when such cams 116 are rotated to extend within a pair of arcuate grooves 119 defined in the cutter block 118. When rotated a predetermined angular distance in a selected direction the cams 116 bias the cutter block 118 through either of the slots 108 and when rotated from the arcuate grooves 119, permit the cutter block to be removed from the sheath 104. A blade 121 is mounted to the cutter block 118 in coplanar relation to the slots 108 and is extended and retracted from the sheath 104 as the cutter block 119 is selectively urged by the cams 116. To remove and replace the blade 121, the sheath 104 is manually forced toward the second plug 103 and disengaged from the lugs 106, wherein the sheath 104 can be rotated for easy access and removal of the cutter block 118 and blade 121.

The blade 121 when extended from the sheath 106 extends between the entry slide 39 and the uppermost roller 41 to protrude a predetermined distance thereabove. To cut a shingle 18 resting on the chute rollers 36, the operator rapidly pulls the handle 111 away from the sheath 104 thereby drawing the blade 121 through the shingle 18.

As shown in FIG. 3, a spring biased locator 107 is pivotally mounted to the rearward end of the primary carriage for selectively contacting the roof 16 at a point on the vertical plane encompassing the second guidewall 48 When in contact with the roof 16, the locator 107 provides a reference point on which the first shingle 18 to be applied to the roof 16 can be abutted for alignment with the second guidewall 48.

As shown in FIGS. 1, 3, 5 & 6 the present invention contemplates the use of means for storing shingles 18 prior to application of those shingles 18 to a roof. In the first embodiment, the storing means includes an arcuate tray 108 detachably mounted to the primary carriage 11 for storing a stack of individual shingles 18. The arcuate formation of the tray 108 serves to bend and separate the individual shingles of the stack thereby facilitating easier removal by the operator.

In the second embodiment, the storing means includes a roller shaft 109 detachably mounted atop the primary carriage 11 in parallel relation to the idler roller 52 for rotational movement about a horizontal axis. The shaft 109 supports a roll of roofing material 54 placed thereon, wherein the roll rotates with the shaft 109 as the strip 54 of roofing material from the roll is fed over the idler roller 52 and down the chute 32.

In operation, the support stands 64 are mounted to the roof 16 in a line perpendicular to the slope thereof. The pivoting pads 67 can be mounted in a variety of angles thereby accommodating variations in the roof's 16 slope. The support stands 64 can be mounted along the crest of a roof 16 with the legs 66 and pads 67 of each support stand straddling the crest. The track rollers 59 are fed within an end of the channel member 61 and the tubular portions 62 of the guide rods 56 are engaged within the casings 76, wherein the primary carriage 11 is indexed to a selected position to begin applying the first row of shingles. The channel member 61 is adjusted to lie parallel to the direction the primary carriage 11 is to travel by the turning of the bolts 71. If the index holes 78 do not accurately place the primary carriage 11 the desired distance down the slope of the roof 16, adjustments in the length of the guide rods 56 can be made by rotating the extension rods 63 relative their threaded engagement within the tubular portion 62. Markings 112 on each extension rod 63 indicate to the operator the distance the guide rod is being altered. The angular relationship between the longitudinal axis of the primary carriage 11 and the channel member 61 can be altered by loosening the wingnuts 84, sliding the support plate 80 a selected distance across the pivot panel 82 and retightening the wingnuts 84.

Once the guiding means are adjusted to the operator's satisfaction the lifting means is activated to lift the gun carriage 19 whereupon the measuring wheel 23 and hub 25 gravitationally reset to a predetermined home position. The raising means is activated to lift the primary carriage 11 and the locator 107 is released to contact the roof 16. A first shingle 18 is fed down the chute 32, below the gun carriage 19 and beneath the rearmost of the inner wheels 14. The first shingle 18 is gravitationally abutted against the locator 107 and second guidewall 48 and the raising means is disengaged, allowing the rearmost inner wheels 14 to rest on the first shingle 18. The lifting means is disengaged, thereby resting the second set of wheels 21 on the first shingle 18. Subsequent shingles are placed on the entry slide 39 for gravitational movement down the chute 32 to abut the preceding shingle and the second guidewall 48. As the operator moves the primary carriage forward by means of a push bar 110, the projecting means 22 automatically fires staples into the shingles placed thereunder, securing these shingles to the roof. As the primary carriage 11 is moved forward, as indicated by arrow "A", the gun carriage 19 supported by the second set of wheels 21 moves over subsequent shingles continually being fed into the chute 32 by the operator, stapling these shingles in passage. When the last shingle on the first row has been stapled, the lifting means and raising means are activated, the second guidewall 48 is unlatched and pivoted outside its vertical plane, thereby providing an avenue for disengagement of the last shingle from the chute 32 and the primary carriage 11 is rolled on its casters 88 to the next highest index position. The primary carriage 11 is moved on its first set of wheels 12 to the beginning point for the second row and the process is repeated. As previously mentioned, the channel member 61 can be readjusted to fan the rows of shingles across the roof 16 and the guide rods 56 can be adjusted to vary the overlap of one row of shingles over another row.

While I have shown my invention in one form, it will be obvious to those skilled in the art that it is not so limited but is susceptible of various changes and modifications without departing from the spirit thereof.

What I claim is:

1. Apparatus for applying shingles to a roof, comprising (a) a primary carriage supported by a first set of wheels;

(b) means laterally encompassed within said primary carriage for securing a shingle within said primary carriage for securing a shingle to an underlying roof, being independently supported by a second set of wheels for concomitant horizontal motion with said primary carriage and having a gun carriage supported on said second set of wheels and means mounted to said gun carriage for projecting fasteners in a downward direction through said shingle to affix said shingle to said roof;

(c) means mounted to said primary carriage for conveying said shingle beneath said securing means; and (d) means connected to said gun carriage for automatically firing said projecting means at selected increments of distance traveled by said gun carriage, wherein said automatic firing means has:

(i) measuring wheel mounted to said gun carriage for rotational movement about a horizontal axis and tangential contact with a subjacent shingle supporting said second set of wheels;

(ii) a hub detachably mounted to said measuring wheel for concomitant rotation therewith having at least one recess defined thereon; and (iii) a micro-switch mounted to said gun carriage having an activating follower that angentially contacts said hub, wherein said micro-switch activates said projecting means when said activating follower falls within said recess.

2. Apparatus as described in claim 1 wherein said measuring wheel comprises a counterweight for returning said measuring wheel and consequently said hub to a home position when said measuring wheel is lifted from said subjacent planar surface.

3. Apparatus as described in claim 1 comprising means mounted to said primary carriage for lifting said gun carriage within said primary carriage.

4. Apparatus as described in claim 1 wherein said lifting means comprises:

(a) a base mounted to said primary carriage;

(b) a plurality of telescopic lift arms pivotally connected to said lift plate in parallel extension toward said gun carriage each having an outer portion wherein said outer portions extend below a lift bar mounted to said gun carriage when said lift arms are telescoped toward said gun carriage;

(c) a lift plate mounted intermediate said outer portions; and (d) a fluid operated linear actuator assembly mounted to said primary carriage subjacent said lift plate.

5. Apparatus as described in claim 4 comprising means mounted to said gun carriage for automatically disabling said projecting means when said gun carriage is lifted and consequently reactivating said projecting means when said gun carriage is lowered.

6. Apparatus as described in claim 5 wherein said disabling means comprises:

(a) a lever arm mounted to said gun carriage for pivotal movement about a horizontal axis; and (b) a linkage connected intermediate said lever arm and said activating follower, wherein said lever arm extends within one of said outer portions when said lift arms are moved beneath said lift bar.

7. Apparatus for applying shingles to a roof, comprising:

(a) a primary carriage supported by a first set of wheels;

(b) means laterally encompassed within said primary carriage for securing a shingle to an underlying roof, being independently supported by a second set of wheels for concomitant horizontal motion with said primary carriage; and (c) means mounted to said primary carriage for conveying said shingle beneath said securing means, wherein said conveying means has an arcuate chute mounted to said primary carriage and having a lower end positioned adjacent said second set of wheels.

8. Apparatus as described in claim 7 wherein said chute comprises a plurality of parallel chute rollers each mounted to said primary carriage for rotation about a horizontal axis and a deflector pan pivotally mounted to said primary carriage adjacent a lowermost roller.

9. Apparatus as described in claim 8 wherein said chute comprises an entry slide mounted to said primary carriage above an uppermost roller of said plurality of chute rollers, wherein said entry slide extends upward from said primary carriage in tangent relation to said arcuate formation of chute rollers having a cover which converges with said slide toward said uppermost roller to form an entry portal.

10. Apparatus as described in claim 9 wherein said conveying means further comprises:

(a) an idler roller mounted to said primary carriage above said cover and parallel said chute rollers for pivotal movement about a horizontal axis; and (b) a spring biased guide roller mounted to said primary carriage subjacent and perpendicular said idler roller for pivotal movement about an axis.

11. Apparatus as described in claim 9 comprising a shingle knife mounted to said primary carriage for selectively cutting said shingles while said shingles are supported on said chute.

12. Apparatus as described in claim 7 wherein said conveying means further comprises:

(a) a first guidewall affixed to said primary carriage normal said chute rollers;

(b) a second guidewall, pivotally mounted to said primary carriage and detachably secured in a vertical plane normal said chute rollers by a latch mounted to said primary carriage;

(c) an auxiliary panel affixed to said primary carriage in opposing relation to said first guidewall wherein the lower marginal edge of said auxiliary panel coextends the arcuate formation of chute rollers being spaced a predetermined distance thereabove.

13. Apparatus as described in claim 12 wherein said conveying means further comprises means connected to said first guidewall, said auxiliary panel and said deflector pan for restricting the vertical movement of said shingles placed on said chute.

14. Apparatus as described in claim 13 wherein said restricting means comprises:

(a) a plurality of parallel restrictive rollers pivotally mounted intermediate said first guidewall and said auxiliary panel in an arcuate formation which coextends said chute rollers in spaced relation thereabove; and (b) a shield connected to the edge of said deflector pan adjacent said first guidewall, wherein said shield extends upwardly and over said deflector pan in spaced relation thereto.

15. Apparatus as described in claim 12, comprising a spring biased shingle locator mounted to said primary carriage for selectively contacting said roof at a point within said vertical plane of said second guidewall.

16. Apparatus for applying shingles to a roof, comprising:

(a) a primary carriage supported by a first set of wheels;

(b) means laterally encompassed within said primary carriage for securing a shingle to an underlying roof, being independently supported by a second set of wheels for concomitant horizontal motion with said primary carriage;

(c) means mounted to said primary carriage for conveying said shingle beneath said securing means; and (d) means mounted to said primary carriage and said roof for guiding said primary carriage in selected directions across said roof.

17. Apparatus as described in claim 16 wherein said guiding means comprises a plurality of guide rods pivotally mounted to said primary carriage and slidably mounted to a guide track; wherein said guide track, when fixably mounted to said roof, provides a reference line along which said carriage is moved in parallel.

18. Apparatus as described in claim 17 wherein said guiding means comprises:

(a) a crossbar connected in perpendicular relation to said guide rods; and (b) a plurality of track rollers fixably connected to said crossbar and slidably engaged within said guide tack.

19. An apparatus as described in claim 18 wherein each said guide rod comprises:

(a) a perforated tubular portion pivotally mounted to said primary carriage; and (b) an extension rod threadably engaged within said tubular portion and rotatably mounted to said crossbar.

20. Apparatus as described in claim 17, wherein said guide track comprises an elongated channel member mounted to a plurality of support stands.

21. Apparatus as described in claim 20 wherein each said support stand comprises:

(a) a plurality of legs, each supported by a pad pivotally mounted thereunder;

(b) two vertical beam members connected to said legs; and (c) a U-shaped adjusting head mounted intermediate said vertical beam members for pivotal movement about a horizontal axis, wherein said channel member is mounted within each said adjusting head by a bolt threadably engaged within said adjusting head and rotatably mounted to said channel member.

22. An apparatus as described in claim 17 further comprising a plurality of tubular casings pivotally mounted to said primary carriage for movement about a horizontal axis, through which said guide rods extend, each said guide rod being secured therein by an index pin slidably mounted to each said tubular casing, wherein said index pin is selectively inserted within one of a plurality of performations located in evenly spaced increments along each said guide rod.

23. Apparatus for applying shingles to a roof, comprising:

(a) a primary carriage supported by a first set of wheels;

(b) means laterally encompassed within said primary carriage for securing a shingle to an underlying roof, being independently supported by a second set of wheels for concomitant horizontal motion with said primary carriage;

(c) means mounted to said primary carriage for conveying said shingle beneath said securing means; and (d) means connected to said primary carriage for raising said primary carriage from said roof, wherein said raising means has a plurality of downwardly extending fluid operated linear actuators mounted to said primary carriage, each having an extendible rod with a caster mounted thereunder.

24. Apparatus for applying shingles to a roof, comprising:

(a) a primary carriage supported by a first set of wheels;

(b) means laterally encompassed within said primary carriage for securing a shingle to an underlying roof, being independently supported by a second set of wheels for concomitant horizontal motion with said primary carriage;

(c) means mounted to said primary carriage for conveying said shingle beneath said securing means; and (d) means detachably mounted to said primary carriage for storing said shingles, wherein said storing means comprises an arcuate tray detachably mounted to said primary carriage.

25. Apparatus for applying shingles to a roof, comprising:

(a) a primary carriage supported by a first set of wheels;

(b) means laterally encompassed within said primary carriage for securing a shingle to an underlying roof, being independently supported by a second set of wheels for concomitant horizontal motion with said primary carriage;

(c) means mounted to said primary carriage for conveying said shingle beneath said securing means; and (d) means detachably mounted to said primary carriage for storing said shingles, wherein said storing means has a shaft detachably mounted to said primary carriage for pivotal movement about a horizontal axis.

26. Apparatus for applying shingles to a roof, comprising:

(a) a primary carriage supported by a first set of wheels; and (b) means detachably connected to said roof and mounted to said primary carriage for guiding said primary carriage in selected directions across said roof, wherein said guiding means has a plurality of guide rods pivotally mounted to said primary carriage and slidably mounted to said guide track.

27. Apparatus as described in claim 26 wherein said guiding means comprises:

(a) a crossbar connected in perpendicular relation to said guide rods; and (b) a plurality of track rollers fixably connected to said crossbar and slidably engaged within said guide track.

28. An apparatus as described in claim 27 wherein each said guide rod comprises:

(a) a perforated tubular portion pivotally mounted to said primary carriage; and (b) an extension rod threadably engaged within said tubular portion and rotatably mounted to said crossbar.

29. Apparatus as described in claim 26 wherein said guide track comprises an elongated channel member mounted to a plurality of support stands.

30. Apparatus as described in claim 29, wherein each said support stand comprises:

(a) a plurality of legs, each supported by a pad pivotally mounted thereunder;

(b) two vertical beam members connected to said legs; and (c) a U-shaped adjusting head mounted intermediate said vertical beam members for pivotal movement about a horizontal axis, wherein said channel member is mounted within each said adjusting head y a bolt threadably engaged within said adjusting head and rotatably mounted to said channel member.

31. An apparatus as described in claim 26 further comprising a plurality of tubular casings pivotally mounted to said primary carriage, through which said guide rods extend, each said guide rod being secured therein by an index pin slidably mounted to each said tubular casings, said index pin being selectively inserted within one of a plurality of perforations located in evenly spaced increments along each said guide rod.

32. Apparatus for applying shingles to a roof comprising:

(a) a primary carriage supported by a first set of wheels;

(b) means detachably connected to said roof and mounted to said primary carriage for guiding said primary carriage in selected directions across said roof; and (c) means connected to said primary carriage for raising said primary carriage from said roof.

33. Apparatus as described in claim 32 wherein said raising means comprises a plurality of downwardly extending fluid operated linear actuators mounted to said primary carriage, each having a distendable rod with a caster mounted thereunder.

34. Apparatus for applying shingles to a roof comprising:

(a) a primary carriage supported by a first set of wheels;

(b) means detachably connected for guiding said primary carriage in selected directions across said roof; and (c) means mounted within said primary carriage for concomitant horizontal motion therewith for securing said shingles to said roof, wherein said securing means has:

(i) a gun carriage supported on a second set of wheels; and (ii) means mounted to said gun carriage for projecting fasteners in a downward direction.

* * * * *